United States Patent [19]

Craig

[11] 4,014,046

[45] Mar. 29, 1977

[54] DISPOSABLE CUFF PROTECTOR

[76] Inventor: Evelyn R. Craig, 1159 Harvard Road, Piedmont, Calif. 94610

[22] Filed: Oct. 10, 1975

[21] Appl. No.: 621,378

[52] U.S. Cl. ..... 2/60

[51] Int. Cl.[2] ..... A41D 27/16

[58] Field of Search ..... 2/59, 60; 206/390; 229/69

[56] References Cited

UNITED STATES PATENTS

| | | | |
|---|---|---|---|
| 1,145,093 | 7/1915 | Swift | 229/69 UX |
| 3,229,875 | 1/1966 | Stoller | 2/49 R X |
| 3,896,524 | 7/1975 | Parker | 206/390 X |

FOREIGN PATENTS OR APPLICATIONS

| | | | |
|---|---|---|---|
| 6,472 | 1885 | United Kingdom | 2/59 |

*Primary Examiner*—Alfred R. Guest
*Attorney, Agent, or Firm*—James R. Cypher

[57] ABSTRACT

A plurality of disposable cuff protectors formed consecutively on a double layer roll of sheet material, by releasably sealing the sheets together along narrow transversely running linear area axially disposed along said sheets. A perforated tear line is disposed within each releasable sealing area for individually separating the cuff protectors one from another. The linear sealing areas are disposed along said sheet with a first plurality of parallel areas placed at an angle to the edge of the sheets, and a second plurality of parallel linear sealing areas intermediate said first sealing areas placed at an angle to said sheet edge and at an angle to said first areas forming cuff protectors having a narrow opening at one end and a wide opening at the other end.

3 Claims, 4 Drawing Figures

DISPOSABLE CUFF PROTECTOR

BACKGROUND OF THE INVENTION

Many persons employed in industry, hospitals and offices are required from time to time to handle liquids or materials which may soil the cuffs of shirts, sweaters or blouses and the lower portion of the sleeves of clothing. For example, a lab technician normally engaged in handling office routines at a desk and must present a neat appearance to the public may be required from time to time to run lab tests involving colored liquids which stain clothing. At the present time, no disposable, water proof, inexpensive clothing protector is available.

Housewives, airline hostesses and other persons wearing long sleeved clothing require temporary cuff protection when they are temporarily called upon to attend to food preparation and other chores which bring them into contact with clothes soiling materials.

SUMMARY OF THE INVENTION

The gist of the present invention is to provide inexpensive, disposable and easily available cuff protectors for long sleeve clothing which are separable from a roll of cuff material.

Another object is to provide cuff protectors which can be worn by everyone, are easy to place in position and easy to remove.

A further object is to provide cuff protectors which are impermeable to most liquids, lightweight, and transparent or translucent.

Still another object is to provide cuff protectors on a roll so that a great many protectors can be efficiently and conveniently stored yet are readily accessible.

A still further object is to provide a sanitary covering over the clothing worn on the arm to prevent its contact with food, laboratory chemicals and other materials where it is important to separate the substances from clothing. A further object is to provide cuff protectors with releasable sealing areas on at least one edge so that the size of the opening may be expanded by unsealing the releasable sealed areas without tearing the material.

Figure 1:
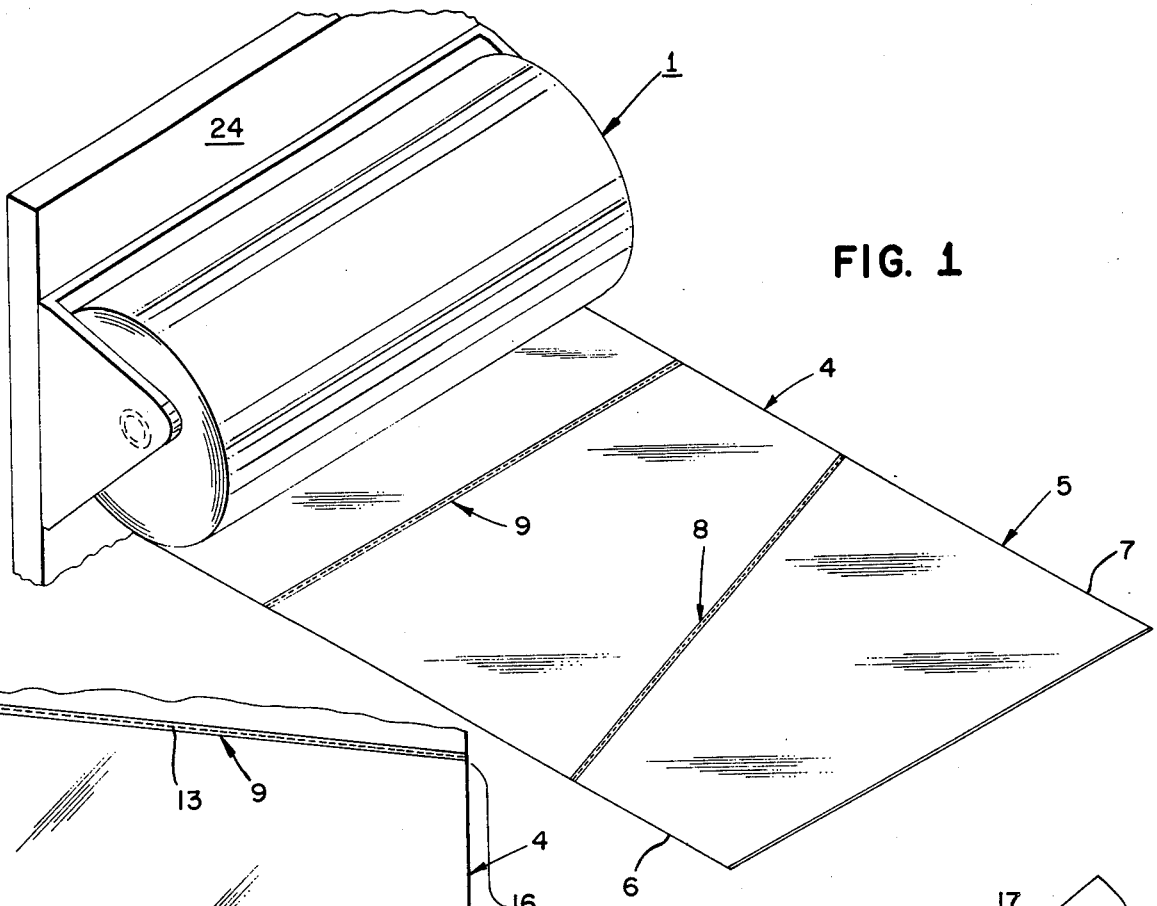
FIG. 1 illustrates a roll of cuff protectors constructed in accordance with the present invention.

BRIEF DESCRIPTION OF THE PREFERRED EMBODIMENTS OF THE INVENTION:

The cuff protectors of the present invention consist briefly of a roll 1 of double layered sheets 2 and 3. Each layer is made up of a plurality of sections 4 and 5 defined by parallel sides 6 and 7 which constitute the outer edges of the sheets. Each of the sections are divided by narrow first and second transversly running linear areas 8 and 9, which define the only areas in releasable sealing contact between each of the layered sheets. The first releasable sealing linear areas 8 are located at spaced intervals along the sheets and extend transversely across the sheets and form a first angle 10 with the outer edges of the sheet. The second releasable sealing linear areas 9 are located at spaced intervals along the sheets and extend transversely across the sheets and form a second angle 11 with the outer edges of the sheet. A first perforated tear line 12 is disposed centrally of the first linear area and extends from outer edge to outer edge of the sheet. A second perforated tear line 13 is disposed centrally of the second linear area and extends from the outer edge to outer edge of the sheet.

The disposable cuff protector is preferably made from a thermoplastic material such as polyvinylchloride, polyvinyl acetate, polyvinyl acetal, polyvinyl alcohol, polyvinylidene chloride, polyethylene, polypropylene as well as the various polyesters well known to form sheet materials.

Figure 2:
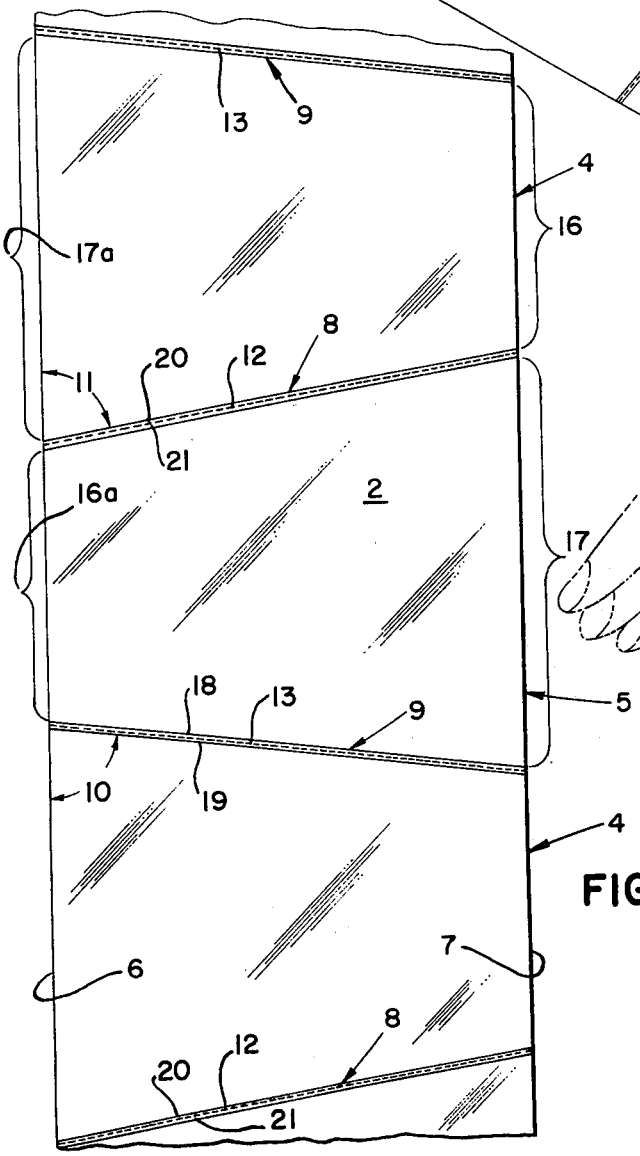
FIG. 2 is a top plan view of an illustrative number of the cuff protectors shown in FIG. 1.
Figure 4:
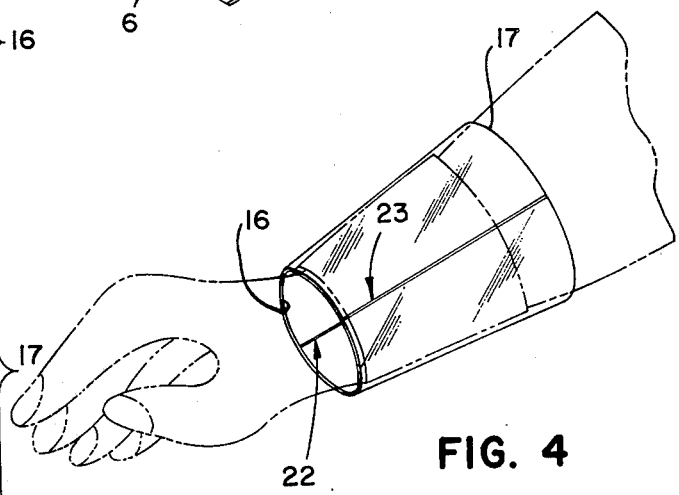
FIG. 4 is a perspective view of a cuff protector shown on the arm of the wearer.
Figure 3:
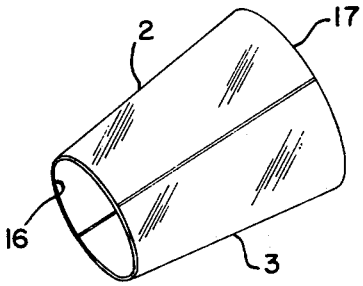
FIG. 3 is a perspective view of a single cuff protector formed in a conical shape.

Referring to FIGS. 3 and 4, it may be seen that the cuff protector is constructed so that the opening 16 at the wrist is smaller than the opening 17 which encircles the forearm. This is accomplished by making the length **16*a* of the wrist opening along side 6 less than the length 17*a* of the forearm opening along side 7 as shown in FIG. 2. As shown also in FIGS. 1 and 2, by alternating the direction of the cuff protectors on the sheets, there is no waste as each individual cuff protector is torn from the roll. It has been found that the distance 16*a* at the wrist should be about 4 inch and the width at the forearm or distance 17*a*** should be about 6 inch.

In order to construct the individual cuff protectors on the roll, the first and second angles 10 and 11 should be between approximately 78° and 83°.

A feature of the present invention is the ability of the cuff protector to accommodate different persons having greatly varying hand sizes. Since thermoplastics have only limited stretching capability and the initial wrist opening is fixed, there must be a way to provide a standard cuff protector which is easily modified to provide a variety of sizes. The problem was solved in a unique way by permitting controlled unsealing of the releasably sealed areas at the cuff protector wrist opening. It was found that best results were obtained by sealing the two sheets together on both sides of the perforated line. The sealing areas 18, 19, 20 and 21 on either side of the perforated line may vary from a negligible amount to about a ¼ inch. When the sheets are sealed together over the full ¼ inch, the materials may be unsealed and separated ½ inch before tearing the sidewall of the cuff protector. Even larger hands can be accommodated by controlled tearing of the cuff protector along the perforated line as indicated by arrows 22 and 23 on FIG. 4.

The perforated tear lines 12 and 13 may be inpressed into the sheet material by any suitable mechanical means well known in the art. The perforated line; in addition to permitting one cuff protector to be separated from another in tearing one from the roll plays another unique role. Since the thermoplastic can be of a type which is more difficult to tear than to separate the releasably sealed areas adjacent the edges, weakening or actually punching an opening all the way through the material makes it easier to tear the material along a definite line so as to permit a person having a large hand to place his hand through the wrist opening. Thus where the linear bonded area is relatively wide, a person separates the releasably bonded area at the wrist and if the hand will still not slip through the opening, the perforated line 12 or both line 12 and 13 are torn as stated above until the hand will enter the wrist opening. Where the cuff protectors are formed with a very thin releasably bonded area on either side of the perforated or weakened line, it is necessary to select a material which is not easily torn along the perforated line.

In use, a roll of the cuff protectors is placed in a suitable dispenser 24 in hospitals, businesses or in the home so that at any time a cuff protector is desired, one may be torn from the remaining cuff protectors. Once separated, the hand is simply thrust through the large opening 17 and down through the smaller opening 16. If the opening at the wrist is too small for the hand, the user simply grasps the cuff protector near opening 17 with one hand and forces his hand through the wrist opening. At first the releasably bonded areas separate and if the opening is still too small, the cuff protector tears along one or both of the perforated lines. It may be seen that with the roll of disposable cuff protectors, the convenience facilitates the frequent use and disposing of the soiled protectors.

While the cuff protector is primarily useful for keeping clothing clean, there are also circumstances where it is essential to keep clothing separated from the substances being handled. Thus in hospitals where sterile conditions are necessary, rather than wear long gloves over the hand and up the arm, the use of short gloves with the cuff protector over the lower arm serves to prevent the clothing or even the bare arm from touching the substances being handled.

In food handling, generally the cuff protector will be used to protect the clothing. In some instances, such as in restaurants, it is more sanitary if clothing does not come in contact with the food.

I claim:

1. A plurality of disposable cuff protectors comprising:

a. a roll of double layered sheet material;

b. a plurality of sections successively formed in said double layered sheet material, each of said sections being defined by parallel sides constituting the outer edges of said sheets;

c. said sections are divided by first and second narrow transversely running controllably releasable sealing linear areas defining the only areas in sealing contact between each of said layered sheets;

d. said first controllably releasable sealing linear areas are located at spaced intervals along said sheets and extend transversely across said sheets and form a first angle with the outer edges of said sheet;

e. said second controllably releasable sealing linear areas are located at spaced intervals along said sheets and extend transversely across said sheets between said first sealing linear areas and form a second angle with the outer edges of said sheet thereby forming a conical tube with one end opening greater than the other;

f. a first perforated tear line disposed centrally of said first linear area and extending from outer edge to outer edge of said sheet; and g. a second perforated tear line disposed centrally of said second linear area and extending from outer edge to outer edge of said sheet.

2. The disposable cuff protectors of claim 1 including said sheet material being composed of a thermoplastic.

3. The disposable cuff protectors of claim 1 comprising:

a. said first and second sealing linear areas form first and second angles of between approximately 78 and 83 degrees with said outer edges.

* * * * *